US005813581A

United States Patent [19]

Hellweg

[11] Patent Number: 5,813,581

[45] Date of Patent: Sep. 29, 1998

[54] POUCH FOR TRUNCHEON

[75] Inventor: Albert Wilhelm Hellweg, Bayswater, Australia

[73] Assignee: Hellweg International Pty Ltd, Bayswater, Australia

[21] Appl. No.: 642,906

[22] Filed: May 6, 1996

[30] Foreign Application Priority Data

Sep. 1, 1995 [AU] Australia ..... PN5156

[51] Int. Cl.[6] ..... A45F 5/00

[52] U.S. Cl. ..... 224/251; 224/242; 224/914

[58] Field of Search ..... 224/191, 242, 224/243, 244, 245, 246, 251, 272, 236, 674, 914

[56] References Cited

U.S. PATENT DOCUMENTS

| | | | |
|---|---|---|---|
| 988,485 | 4/1911 | Mitchell | 224/242 |
| 4,453,769 | 6/1984 | Parsons et al. . | |
| 4,588,116 | 5/1986 | Litman . | |
| 4,662,552 | 5/1987 | Uyehara . | |
| 4,886,197 | 12/1989 | Bowles et al. | 224/245 |
| 4,955,518 | 9/1990 | Parsons et al. . | |
| 5,211,322 | 5/1993 | Nealy . | |
| 5,217,151 | 6/1993 | Parsons . | |
| 5,263,619 | 11/1993 | Shoemaker . | |
| 5,284,281 | 2/1994 | Nichols | 224/244 |
| 5,392,975 | 2/1995 | Blankenship, Jr. . | |
| 5,449,104 | 9/1995 | Parsons et al. | 224/245 |

*Primary Examiner*—Henry J. Recla
*Assistant Examiner*—Gregory M. Vidovich
*Attorney, Agent, or Firm*—Hughes Hubbard & Reed LLP; Ronald Abramson; Peter A. Sullivan

[57] ABSTRACT

A pouch for a truncheon or baton having a body with an open upper end with a retaining flap to hold the truncheon in the pouch; and a lower end having at least one finger to enable the passage therethrough of the shaft of the truncheon when in the extended position, yet preventing unwanted extension of the shaft when the truncheon is placed in the pouch in the retracted position.

2 Claims, 6 Drawing Sheets

POUCH FOR TRUNCHEON

FIELD OF THE INVENTION

This invention relates to a pouch for truncheons and refers particularly, although not exclusively, to a pouch for releasably retaining therein an extendable truncheon.

Throughout this specification reference to truncheon is to include reference to a baton, or other product having a telescopically slideable shaft including, for example, a telescope.

BACKGROUND OF THE INVENTION

Truncheons have been used by security guards and law enforcement officers for many years. They are normally carried in a pouch or holder mounted on the belt of the user. These truncheons have varied from an elongate bat somewhat resembling a smaller baseball bat, to a device commonly used which is elongate with a perpendicular handle.

These have been found to be successful in use, but awkward to carry in that their size and bulk can interfere with the wearer when performing normal duties. They are also difficult to retract and can be difficult to place into their holder or pouch. Therefore, there has been developed a form of truncheon which comprises a handle portion having at least one, and preferably two, extendable portions telescopically mounted therein. With this form of truncheon, a hard swing by the user will cause automatic extension of the telescoping portions to their extension limit to provide a secure and easily useable truncheon. These truncheons are normally carried in a pouch on the belt of a user. These pouches normally resemble the shape of the handle, and have an opening at the bottom so that the truncheon can be carried therein in either the extended or retracted position.

However, it has been found that if the truncheon is placed in the pouch in the retracted position, and if the wearer is engaging in moderately active physical work or exercise, the truncheon may accidentally extend and interfere with the user. For a law enforcement officer chasing a criminal over fences and the like, this may cause an accident.

Examples of such truncheon holders can be found in U.S. Pat. No. 4,955,518 to Parsons et al; U.S. Pat. No. 4,953,769 to Parsons et al; and U.S. Pat. No. 4,662,552 to Uyehara. In U.S. Pat. No. 4,955,518 to Parsons et al there is shown a base which can be attached to a belt or waistband of a wearer by an integral clip. Attached to the base is an upper retaining ring, and a lower retaining ring. The upper retaining ring has a cover strap therearound with a snap fastener to retain the truncheon therein. The lower retaining ring is in the form of an inverted, truncated cone. Both the upper and lower retaining rings have longitudinally extending breaks to enable the truncheon to be speedily removed, if desired. There is no disclosure of any component which may act to prevent the unwanted extension of the truncheon when in the holder.

Similar comments may be made in relation to U.S. Pat. No. 4,953,769 of Parsons et al which is a form of baton holder but with only one retaining ring. Although ease of removal is thereby created, the baton would not be secured therein, and it is not suitable for use with telescoping batons.

Again U.S. Pat. No. 4,662,552 of Uyehara is similar to the Parsons et al reference, but with a single sleeve only. It is not useable with a telescoping baton as the sleeve is cylindrical and it would permit unwanted extension of the baton.

A further example of a truncheon or baton holder is disclosed in U.S. Pat. No. 5,263,619 to Shoemaker. This discloses a holder having a generally tubular body with a cover member at the upper end thereof, and a rigid annular ring located within the body at the lower end thereof. The ring supports the outermost section of the truncheon. The ring has an opening of sufficient diameter to permit an extended baton or truncheon to be placed in the body. There is no disclosure of any means to allow the truncheon baton to be inserted in either the extended or retracted condition, yet prevent unwanted extension of the baton truncheon when in the holder.

U.S. Pat. No. 5,217,151 to Parsons has addressed the problems of accommodating a baton in either the extended or unextended positions by having two pockets—one for the baton when expanded, and one for the baton when unexpanded. This results in unnecessary manufacturing costs due to duplication in material and assembly, and would be difficult to use in a crisis situation as a user may attempt to place the baton in the incorrect pocket for the condition of the baton. It also does not address the problem of undesired extension of the baton when in the rear pocket.

U.S. Pat. No. 5,392,975 of Blankenship discloses a spray container storage and retrieval system which is not useable with an extendable baton. Similarly, U.S. Pat. No. 4,588,116 of Litman discloses a holster for a tear gas projection which is not useable with an extendable baton. The security sheath for knives of U.S. Pat. No. 5,211,322 likewise has a sealed end and therefore is not able to be used with an extendable baton.

It is therefore the principle object of the present invention to provide a pouch for a truncheon (as hereinbefore defined) which enables the truncheon to be placed into the pouch in the retracted or extended position, but will not allow for unwanted extension of the truncheon if placed in the pouch in the retracted position.

BRIEF DESCRIPTION OF THE INVENTION

With the above and other objects in mind, the present invention provides a pouch for a truncheon having a handle and a telescopically extendable shaft, the shaft being adapted to be retracted into the handle such that substantially all of the shaft is within the handle; the pouch having a body with a hollow interior, an open upper end, and a lower end; the open upper end being adapted to be closed at least in part by a flap so as to releasably retain the truncheon in the body; the lower end being at least partially open so as to enable the shaft of the truncheon when in the extended position to pass therethrough but to prevent the passage therethrough of the handle and to prevent passage therethrough of the shaft when in the retracted position.

Preferably, there is at least one deflectable finger extending into the hollow interior at or adjacent the open lower end.

Preferably, the at least one finger is adapted to support a lower end of the shaft of the truncheon when the truncheon is placed in the pouch in the retracted position so as to prevent the shaft extending, but which is able to be deflected by the lower end of the shaft of the truncheon when the truncheon is placed in the pouch in the extended position.

Advantageously, the finger has a resistance to movement at least as great as the weight of the extendable shaft of the truncheon.

Advantageously, the resistance to movement is greater than the weight of the shaft of the truncheon, and any momentum it may have, in the axial direction of the shaft.

Preferably, the distance between the radical inner most end of the finger and the opposite wall of the body is less than the transverse dimensions of the shaft of the truncheon.

Advantageously, there are a plurality of equally spaced fingers with the transverse cross-sectional area between the radially innermost ends of the fingers being less than the transverse cross-sectional area of the lowermost portion of the shaft. More advantageously, there are three or four such fingers.

In an alternative embodiment, there is provided a pouch for a truncheon having handle and a telescopically extendable shaft, the pouch having a hollow interior, an open upper end, and a lower end; the open upper end being adapted to be closed at least in part by a flap so as to releasably retain the truncheon in the body; the lower end being at least partially open so as to enable the shaft of the truncheon when in the extended position to pass therethrough but preventing the passage therethrough of the handle of the truncheon, the body having at least one deflectable finger extending axially downwardly and radially inwardly to prevent unwanted extension of the shaft when the truncheon is placed in the pouch in the retracted position.

DESCRIPTION OF THE DRAWINGS

A preferred construction of a pouch for a truncheon incorporating the preferred features of the present invention will now be described by way of example only and with reference to the accompanying illustrative drawings in which.

Figure 1:
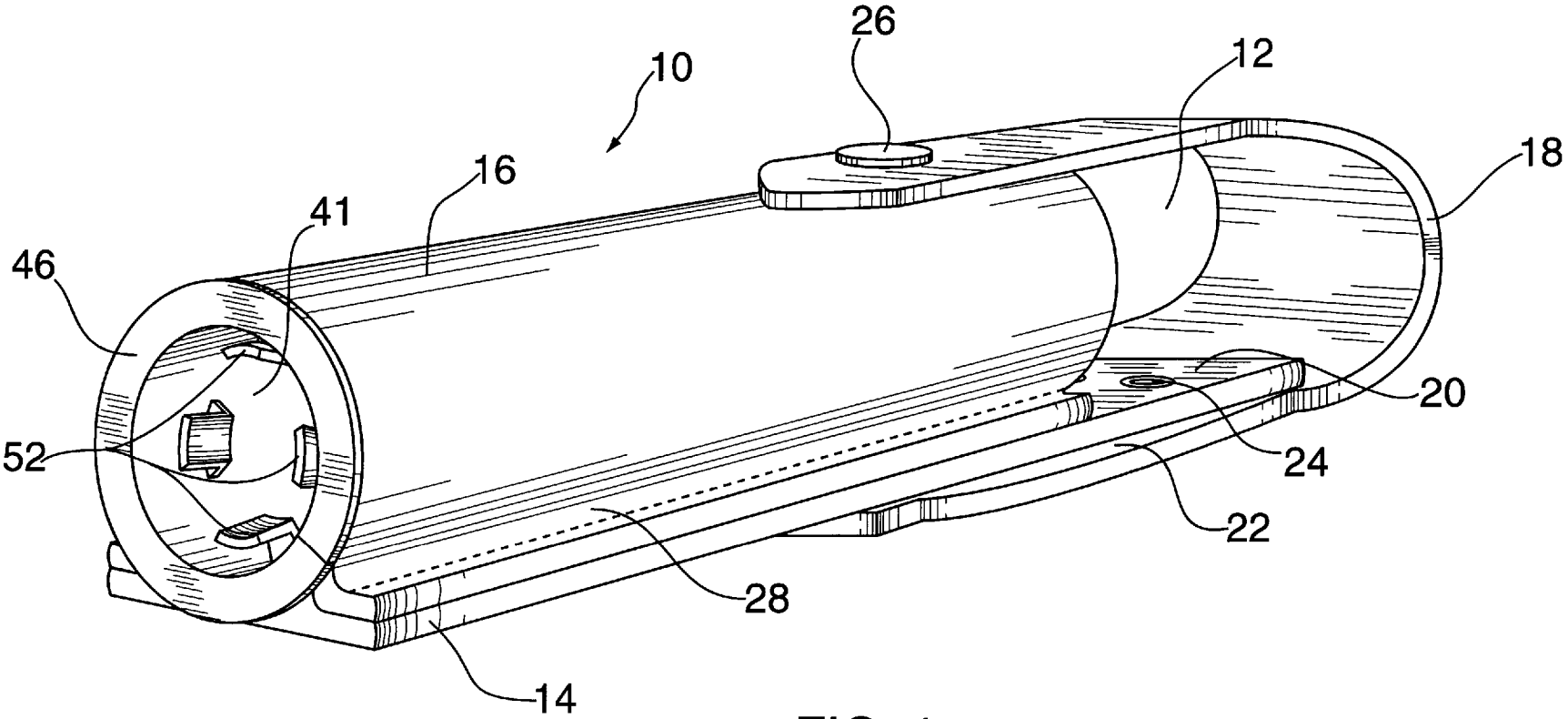
FIG. 1 is a perspective view from below of the pouch with a truncheon inserted.

To now refer to FIGS. 1 to 6, there is shown a pouch generally designated as 10 for holding a truncheon 12. The pouch 10 has a base 14, a body 16 and a flap 18. The flap 18 is secured to the underneath of base 14 at approximately the mid-point of the length of the base 14, and adjacent the top 20 of base 14, so as to create a belt loop 22. The securing may be by any suitable means such as, for example, gluing and/or stitching and/or use of rivets such as rivets 24. In addition, bolts or screws may be used.

The flap 18 is elongate to create a closure. The use of a press stud 26 or the like on body 16 and flap 18 enables the flap 18 to be able to be secured to the body 16 at its outermost end.

The body 16 is secured to the base 14 by any suitable means such as, for example, gluing and/or stitching 28. In addition, bolts and/or rivets may be used.

The body 16 is generally shaped as a hollow cylinder and is adapted to hold therein the truncheon 12. As is clear from FIG. 2, the truncheon 12 has a handle portion 30 and a telescopically extendable shaft 32 having an intermediate portion 34 and an end portion 36. At its lower most end 38, end portion 36 has a head or knob 40.

The body 16 has a hollow interior 41, an open upper end 42, and an open lower end 44. Located in the lower end 44 is an insert 46. The insert 46 is secured in the lower end 44 by any suitable means such as, for example, rivets, bolts, screws, gluing or the like.

The insert 46 may be made as a separate component, as illustrated, or may be made integral with the body 16.

The insert 46 is dimensioned to be a "tight" fit within the lower end 44 and to receive the handle 30 of truncheon 12. It has a generally hollow cylindrical body portion 48, and lower flange portion 50 adapted to press against the lower end 44 of body 16. The body 48 of insert 46 is dimensioned so that the lower end of the handle 30 of truncheon 12 is a tight but easy fit therein.

Extending radially inwardly of the body 48 are a number of fingers 52. The fingers 52 are shaped so that the lower end 54 of handle 30 will easily rest thereon. The inherent strength of fingers 52 should be sufficient to hold the truncheon 12 in the pouch 10 when in use, allowing for appropriate momentum. The distance between fingers 52 is less than the diameter of head 40 of lower most portion 38 of shaft 32 of truncheon 12. In this way, as is clear from FIG. 4, the head 40 will rest on the fingers 52.

Advantageously, the fingers 52 are shaped so that they extend not only radially inwardly but also axially downwardly. They are preferably somewhat "L" in shape so as to create a resistance to the passage therethrough of the head 40.

Figure 2:
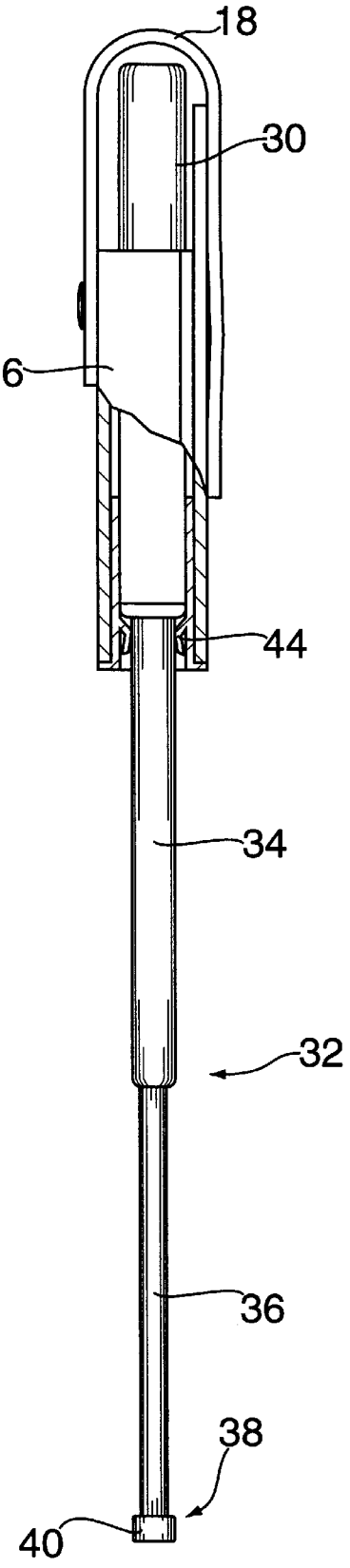
FIG. 2 is a side view of the pouch of FIG. 1, in partial section, with the truncheon shaft extended.
Figure 3:
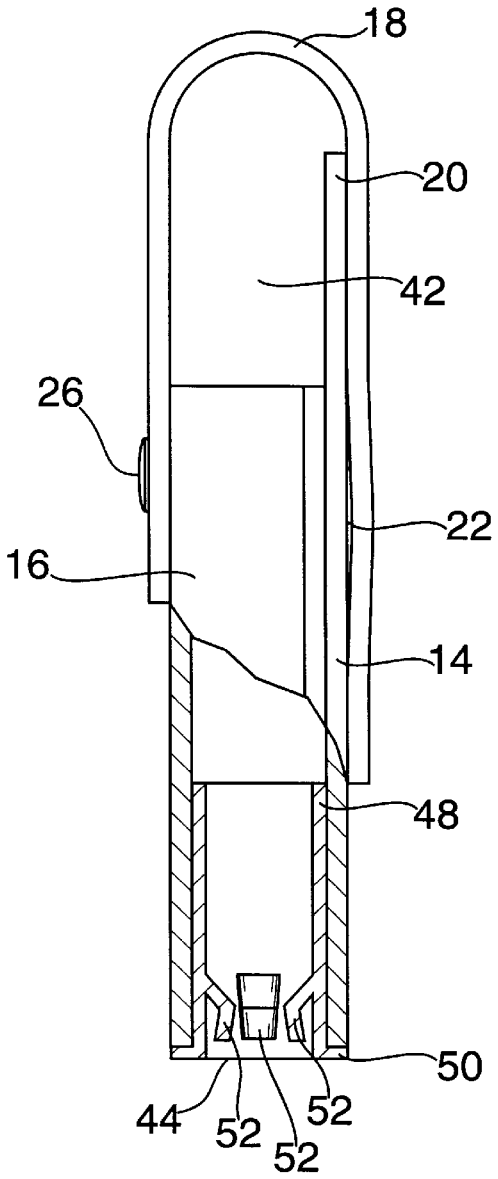
FIG. 3 is a side view of the pouch of FIGS. 1 and 2, in partial section, without the truncheon.
Figure 4:
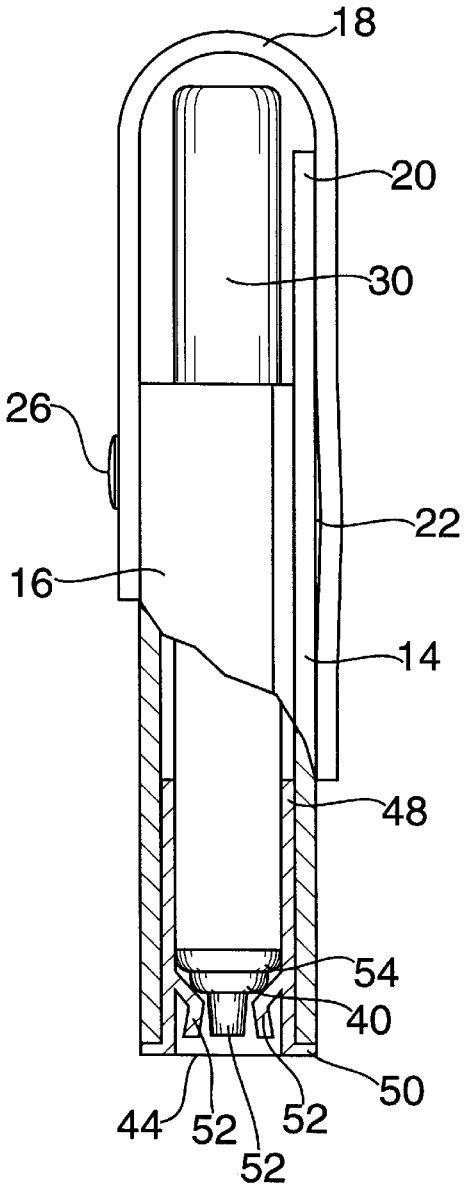
FIG. 4 is a side view corresponding to that of FIG. 3 with the truncheon inserted.
Figure 5:
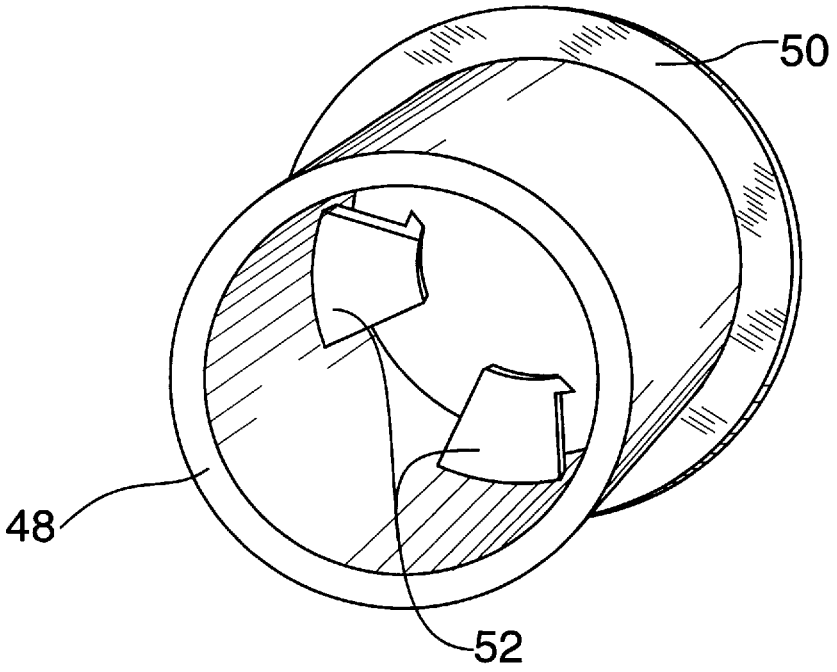
FIG. 5 is a perspective view from the other end of an insert for the pouch of FIGS. 1 to 4.
Figure 6:
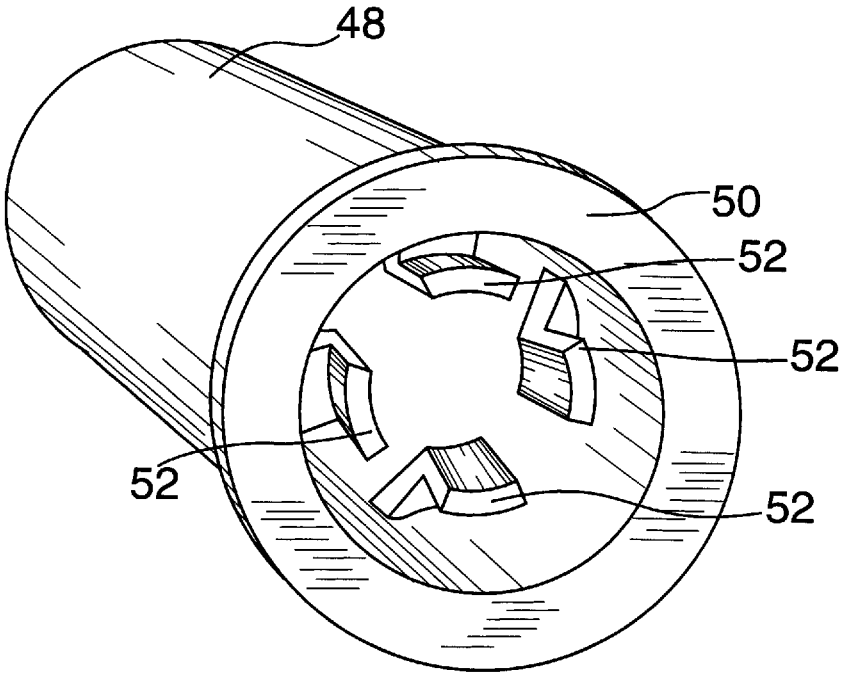
FIG. 6 is a perspective view from the lower end of the insert of FIG. 5.

As is clear from FIG. 2, however, the shaft 32 of truncheon 12, but not handle 30, is able to pass through the fingers 52 when the shaft 32 is in the extended position shown. This should be by deliberate action of a user. If the truncheon 12, in the extended position shown in FIG. 2, is placed in pouch 10, the head 40 can be forced through the fingers 52 to enable the shaft 32 to pass between the fingers 52. The handle 30 cannot extend past fingers 52 without sufficiently excessive force being exerted to destroy fingers 52. The truncheon 12 is able to be withdrawn by being moved axially upwardly until the head 40 is forced between the fingers 52. However, when the truncheon 12 is placed in the pouch with the shaft 32 in the retracted position (as is shown in FIG. 4) the head 40 rests against the fingers 52 and is not forced therebetween. Even if the wearer of the pouch 10 engages in rigorous activity or exercise, the resistance to movement in the fingers 52 should be sufficient to prevent accidental, axial extension of shaft 32.

Figure 7:
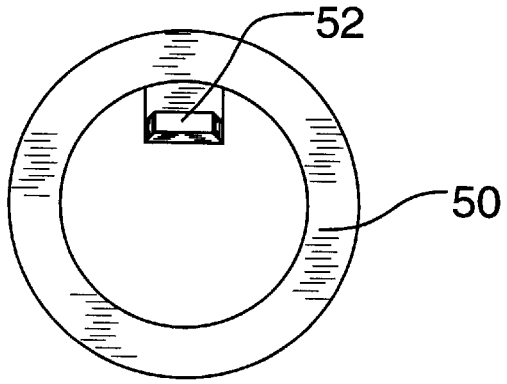
FIG. 7 is a lower end view of the alternative insert to that of FIG. 6.
Figure 8:
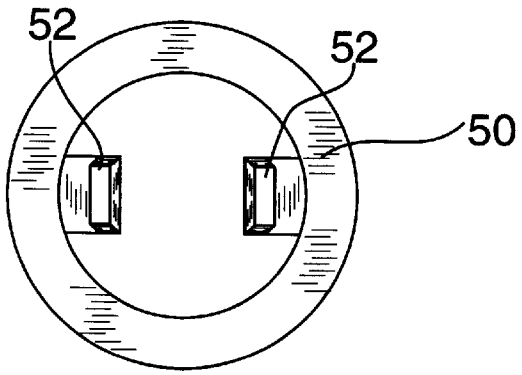
FIG. 8 is an end view of an alternative insert to that of FIG. 6.
Figure 9:
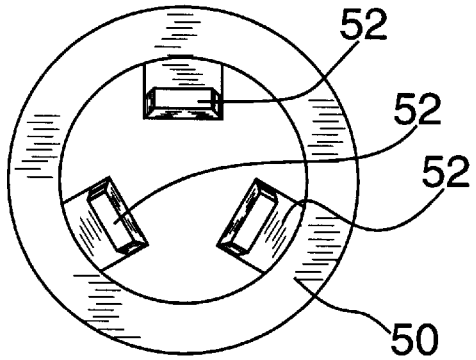
FIG. 9 is a third alternative insert to that of FIG. 6.
Figure 10:
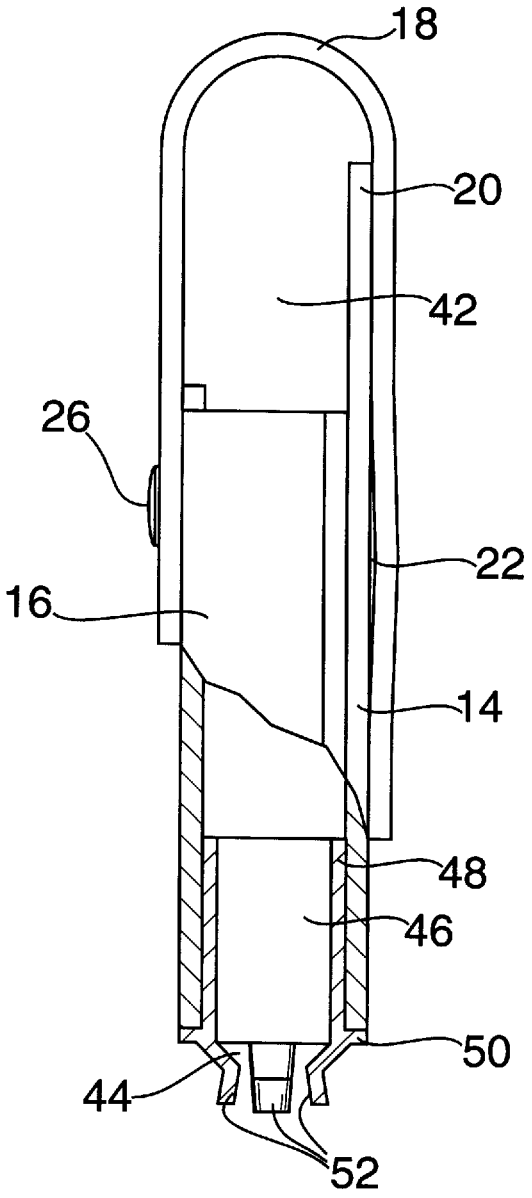
FIG. 10 is a side view, similar to that of FIG. 3, of a second embodiment.

There may be any suitable number of fingers 52 and this is clearly illustrated in FIGS. 7, 8 and 9 where, in the instance of FIG. 7, there is one finger 52; in FIG. 8 there are two fingers 52; and in FIG. 9 there are three fingers 52. Alternatively, instead of fingers 52, there may be a flexible O-ring or like device which is of sufficient flexibility to enable the head 40 to pass through there as required. Furthermore, as is illustrated in FIG. 10, the fingers 52 may be mounted externally and extend beyond flange 50. If only one finger 52 is used, as in FIG. 7, this distance between the innermost end of finger 52 and the diametrically opposed wall of body 48 should be less than the diameter of head 40.

The pouch 10 may be made of any suitable material such as, for example, leather, imitations of leather, plastics, metal, or the like. Other than the fingers 52, the only component of the pouch requiring flexibility is the flap 18.

The insert 46 may also be made of any suitable material such as leather, imitations of leather, plastics, metal or the like. The only requirement is that the fingers 52 has sufficient strength to hold the shaft 32 in the retracted position, and sufficient flexibility to enable the head 40 to pass therebetween when hand pressure of a user is applied, and for the head 40 to be able to be withdrawn therebetween upon appropriate hand pressure being applied.

Whilst there has been described in the foregoing description a preferred embodiment of a pouch for a truncheon, it will be realised by those skilled in the technology concern that there may be many variations or modifications in details of design or construction without departing from the essential features of the present invention.

It is claimed:

1. A pouch for a truncheon having a handle and a telescopically extendable shaft adapted to be retracted into the handle such that substantially all of the shaft is within the handle; the pouch having a cylindrical body with a hollow interior, an open upper end, and an open lower end; the open upper end being adapted to be closed at least in part by a flap so as to releasably retain the truncheon in the body; a hollow cylindrical insert with a lower flange portion connected thereto, said insert mounted in the lower end of said cylindrical body with said flange portion pressing against the lower end of said body for supporting said handle permitting the shaft of the truncheon when in an extended position to pass therethrough and preventing the passage therethrough of the handle; flexible finger means comprising an L-shaped finger mounted within said insert adjacent the lower end adapted to engage and support a lower end of the shaft of the truncheon within the body when the truncheon is placed in the pouch in a retracted position so as to provide a seating surface for said shaft, said finger means being flexible and able to be deflected by the lower end of the shaft of the truncheon to enable the truncheon to be placed in and axially withdrawn from the pouch when the truncheon is in the extended position.

2. A pouch as claimed in claim 1, wherein the finger has a resistance to movement at least as great as the weight of the shaft of the truncheon plus any momentum of the shaft.

* * * * *